US007354024B2

(12) United States Patent
Winig et al.

(10) Patent No.: US 7,354,024 B2
(45) Date of Patent: Apr. 8, 2008

(54) PEGBOARD WALL-PLUG STORAGE SYSTEM

(75) Inventors: Alan Winig, Wynnewood, PA (US); Richard Winig, Villanova, PA (US); James Eldon, Barto, PA (US)

(73) Assignee: SS3 Storage Systems, L.L.C., Wilmington, DE (US)

( * ) Notice: Subject to any disclaimer, the term of this patent is extended or adjusted under 35 U.S.C. 154(b) by 149 days.

(21) Appl. No.: 11/376,451

(22) Filed: Mar. 14, 2006

(65) Prior Publication Data

US 2007/0215768 A1 Sep. 20, 2007

(51) Int. Cl.
*A47B 96/06* (2006.01)

(52) U.S. Cl. ..... 248/220.22; 248/220.21; 52/36.4; 411/508; 403/326; 211/54.1

(58) Field of Classification Search ..... 248/220.22, 248/220.21, 220.31, 220.41; 52/36.4, 220.8, 52/204.52, 307.7; 411/508–510, 91; 403/326, 403/329; 211/54.1, 57.1, 59.1
See application file for complete search history.

(56) References Cited

U.S. PATENT DOCUMENTS 1,856,752 A * 5/1932 Ellinger ..... 248/261
2,359,163 A * 9/1944 Sherts ..... 52/204.52
2,954,874 A * 10/1960 Rouse ..... 211/85.9
3,091,423 A * 5/1963 Butterworth ..... 248/220.43
3,322,287 A * 5/1967 Ragir ..... 211/87.01
4,209,098 A * 6/1980 Adams ..... 211/70.8
4,264,013 A * 4/1981 Vollmer ..... 211/85.2
5,144,777 A * 9/1992 Fishel et al. ..... 52/144
5,511,622 A * 4/1996 Thompson ..... 169/70
5,823,700 A * 10/1998 Poworoznek ..... 403/245
6,349,507 B1 * 2/2002 Muellerleile ..... 52/36.5
6,374,455 B1 * 4/2002 Regele et al. ..... 16/2.1
6,443,316 B1 * 9/2002 Mao ..... 211/74
6,561,474 B1 * 5/2003 Walter et al. ..... 248/220.22
6,574,924 B2 * 6/2003 Maniezzo ..... 52/36.4
6,581,788 B1 6/2003 Winig et al.
6,848,589 B2 * 2/2005 Wood ..... 211/189
6,935,518 B2 * 8/2005 Winig et al. ..... 211/90.02
7,131,806 B2 * 11/2006 Hansen ..... 411/41
7,155,775 B2 * 1/2007 Mockett ..... 16/2.1
7,210,660 B2 * 5/2007 James et al. ..... 248/220.31

* cited by examiner

*Primary Examiner*—Kimberly T. Wood
(74) *Attorney, Agent, or Firm*—Duane Morris LLP

(57) ABSTRACT

A system and apparatus for storing an item is provided that includes a pegboard wall-plug having a plate including a central opening. A tube projects outwardly from a rear surface of the plate in surrounding relation to the central opening. A plurality of circumferentially arranged, spaced-apart parallel ridges project outwardly from a surface of the cylindrical tube. A hole is defined by a surface of a wall where the surface defines a diameter of the hole that is less than a diameter of at least one of the circumferentially arranged, spaced-apart parallel ridges. In this way, when the tube is received within the hole, the circumferentially arranged, spaced-apart parallel ridges engage and bite into the surface so as to retain the pegboard wall-plug in the wall.

14 Claims, 12 Drawing Sheets

PEGBOARD WALL-PLUG STORAGE SYSTEM

FIELD OF THE INVENTION

The present invention generally relates to storage and organizational systems, and more particularly to structures used to mount storage and organizational systems onto vertical surfaces.

BACKGROUND OF THE INVENTION

Storage and organizational systems of the type in which a composition board with a plurality of holes is mounted vertically on a surface are well known in the art. These systems, known as pegboards, are often adapted to receive support devices, e.g., hook and peg members, which extend into the holes so that articles may be supported from the forwardly projecting portions of the support device.

Mounting a pegboard in a home typically requires securing the pegboard on a wall of the house. Typical walls in a home are often constructed of either plaster or gypsum board supported upon wall studs. The pegboard is mounted on the outer surface of the wall, or on to a framework secured to the wall, by placing fasteners, e.g. screws, through several holes disbursed throughout the pegboard, and then driving each fastener into the frame, or through the frame and into a stud. Frames are often necessary to provide sufficient space between the back surface of the pegboard and the wall of the home so as to accommodate engagement portions of the support devices, e.g., hook and peg members, which extend into the holes so that articles may be supported from forwardly projecting portions of the support device.

This arrangement is often aesthetically undesirable, as it requires large surfaces of the supporting wall to be covered by the pegboard. The size of the pegboard, to some extent, also limits the locations that a storage system may be placed. In pegboard systems such as are disclosed in U.S. Pat. No. 6,581,788, a perforated panel is provided in the form of a planer sheet of material, preferably formed of a metal or polymer, and having a plurality of regularly shaped perforations, disposed in a regular pattern throughout the panel. The perforations are each preferably formed so as to be defined by a circumferential edge, often forming a rectangular or square opening in the panel. The perforated panel is typically about one quarter to one half of an inch thick, with the perforations being arranged in a regular pattern through panel. These panels are often provided in three-by-three or four-by-four foot sheets.

There is a need for a pegboard-type mounting system that is compact and able to be arranged in a variety of locations on a wall of a structure without covering excessive portions of the wall's surface or requiring holes to be formed entirely through the wall of the structure.

SUMMARY OF THE INVENTION

The present invention provides a pegboard wall-plug including a plate having a central opening and a tube projecting outwardly from a rear surface of the plate in surrounding relation to the central opening. A plurality of circumferentially arranged, spaced-apart parallel ridges project outwardly from a surface of the cylindrical tube.

In one embodiment of the invention, a system for storing an item is provided that includes a pegboard wall-plug having a plate including a central opening. A tube projects outwardly from a rear surface of the plate in surrounding relation to the central opening. A plurality of circumferentially arranged, spaced-apart parallel ridges project outwardly from a surface of the cylindrical tube. A hole is defined by a surface of a wall where the surface defines a diameter of the hole that is less than a diameter of at least one of the circumferentially arranged, spaced-apart parallel ridges. In this way, when the tube is received within the hole, the circumferentially arranged, spaced-apart parallel ridges engage and bite into the surface so as to retain the pegboard wall-plug in the wall.

In another embodiment of the invention, a system for storing an item is provided that includes a pegboard wall-plug having a plate including a central opening. A tube projects outwardly from a rear surface of the plate in surrounding relation to the central opening. A plurality of circumferentially arranged, spaced-apart parallel ridges project outwardly from a surface of the cylindrical tube. A hole is defined by a surface of a wall where the surface defines a diameter of the hole that is less than a diameter of at least one of the circumferentially arranged, spaced-apart parallel ridges. In this way, when the tube is received within the hole, the circumferentially arranged, spaced-apart parallel ridges engage and bite into the surface so as to retain the pegboard wall-plug in the wall. An item holder, such as a hook with a catch or a bracket for a shelf, is then positioned within the opening in the pegboard wall-plug. The catch may comprise a curved cantilevered strap projecting from the end and having a stop tab located at a strap end positioned above, but spaced away from the end so that when the cantilevered strap is inserted into the central opening defined through the plate, the catch is releasably engaged with the plate with the stop tab positioned on a front surface of the plate.

In a further embodiment, a system for supporting an item being is provided that includes a pegboard wall-plug having a plate including a central opening, and a tube projecting outwardly from a rear surface of the plate in surrounding relation to the central opening, a circumferential end edge, and a plurality of circumferentially arranged, spaced-apart parallel ridges projecting outwardly from a surface of the cylindrical tube. A blind hole is defined by an inner circumferential surface and an inner transverse surface of a wall on which items are to be hung or stacked for storage. The inner circumferential surface defines a diameter of the hole that is less than a diameter of at least one of the circumferentially arranged, spaced-apart parallel ridges so that when the tube is received within the hole, the circumferentially arranged, spaced-apart parallel ridges engage and bite into the surface so as to retain the pegboard wall-plug in the wall with the circumferential end edge rests upon the inner transverse surface of the wall. An item holder is provided that includes a catch located at an end. The catch comprises a curved cantilevered strap that projects from the end and has a stop tab located at a strap end positioned above, but spaced away from the end. When the cantilevered strap is inserted into the central opening defined through the plate, the catch is releasably engaged with the plate with the stop tab being positioned on a front surface of the plate and void is defined between the cantilevered strap and the inner transverse surface of the wall.

BRIEF DESCRIPTION OF THE DRAWINGS

These and other features and advantages of the present invention will be more fully disclosed in, or rendered obvious by, the following detailed description of the preferred embodiments of the invention, which are to be considered together with the accompanying drawings wherein like numbers refer to like parts and further wherein.

DETAILED DESCRIPTION OF THE PREFERRED EMBODIMENT

Figure 1:
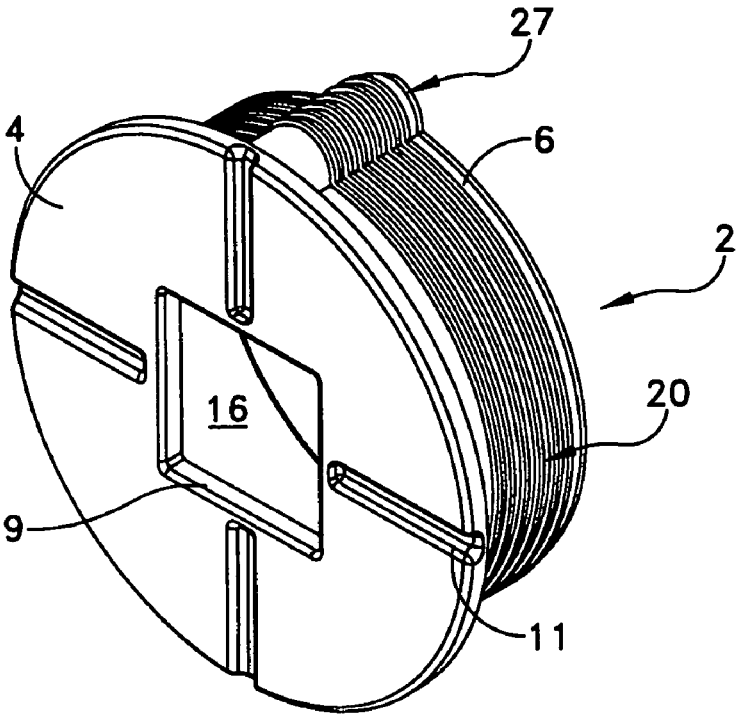
FIG. 1 is a perspective view of a pegboard wall-plug formed in accordance with the present invention.
Figure 2:
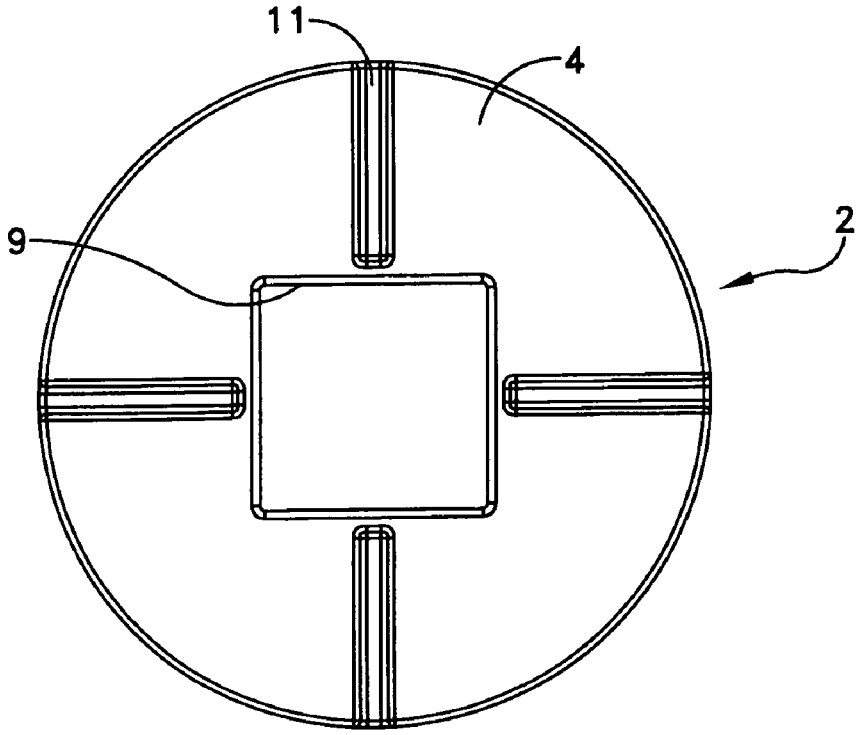
FIG. 2 is a front elevational view of the pegboard wall-plug shown in FIG. 1.
Figure 3:
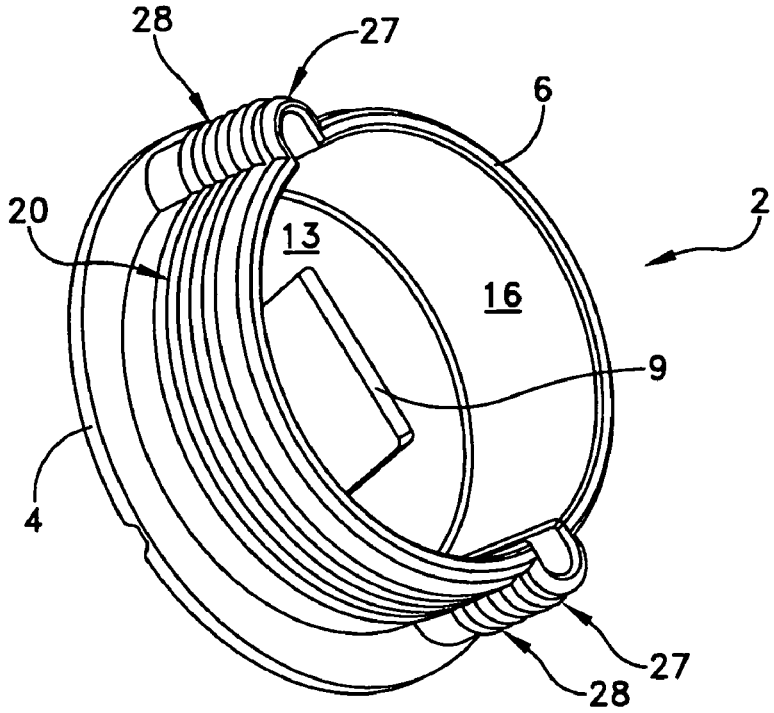
FIG. 3 is a rear perspective view of the pegboard wall-plug shown in FIG. 1.
Figure 4:
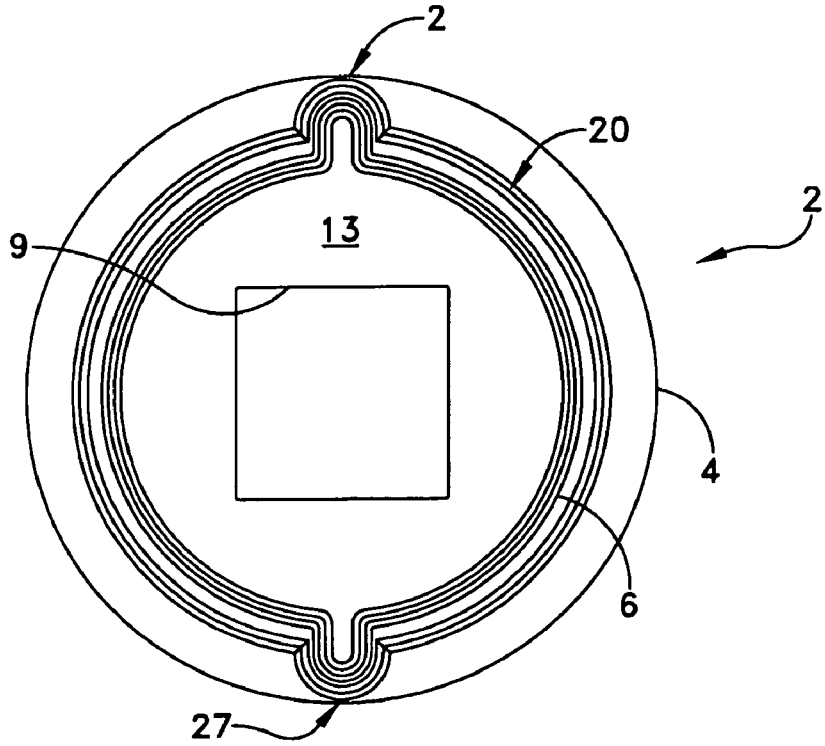
FIG. 4 is a rear elevational view of the pegboard wall-plug shown in FIG. 2.

This description of preferred embodiments is intended to be read in connection with the accompanying drawings, which are to be considered part of the entire written description of this invention. The drawing figures are not necessarily to scale and certain features of the invention may be shown exaggerated in scale or in somewhat schematic form in the interest of clarity and conciseness. In the description, relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. In the claims, means-plus-function clauses, if used, are intended to cover the structures described, suggested, or rendered obvious by the written description or drawings for performing the recited function, including not only structural equivalents but also equivalent structures.

Referring to FIGS. 1-7, a pegboard wall-plug 2 formed in accordance with the present invention includes a front plate 4 and a tubular insert 6. Pegboard wall-plug 2 may be made of any suitable engineering material, such as, and without limitation, plastics, thermoplastics (crystalline or non-crystalline, cross-linked or non-cross-linked), thermosetting resins, elastomers, or composites thereof, metal alloys, ceramics, wood, wood-plastic composites, plastic-glass fiber reinforced composites, or other materials so long as they provide sufficient structural rigidity and strength for supporting a weight that is cantilevered from its front surface.

Figure 5:
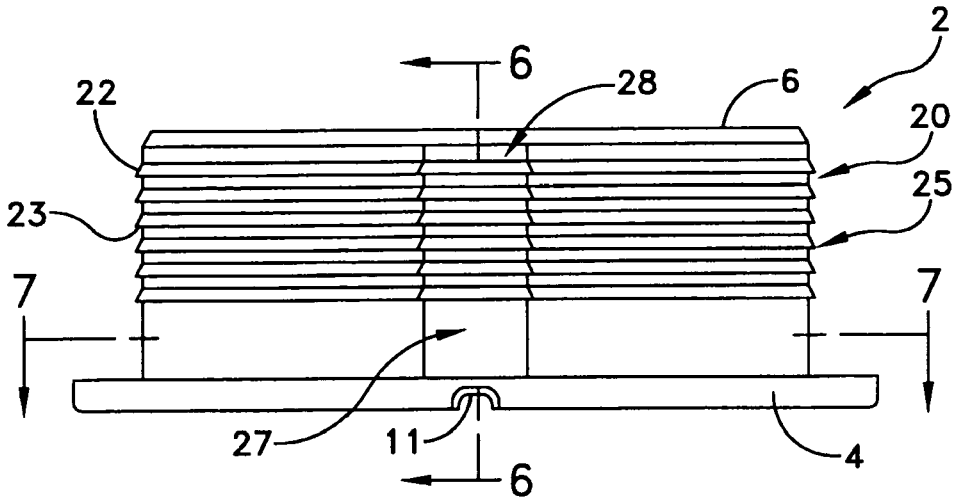
FIG. 5 is a top plan view of the pegboard wall-plug shown in FIGS. 1-4.
Figure 6:
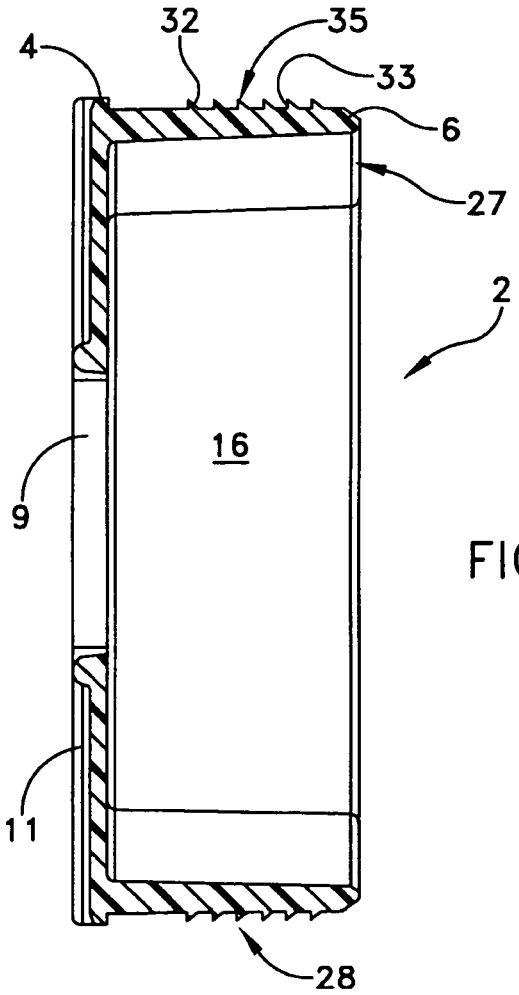
FIG. 6 is a side cross-sectional view, as taken along lines 6-6 in FIG. 5.
Figure 7:
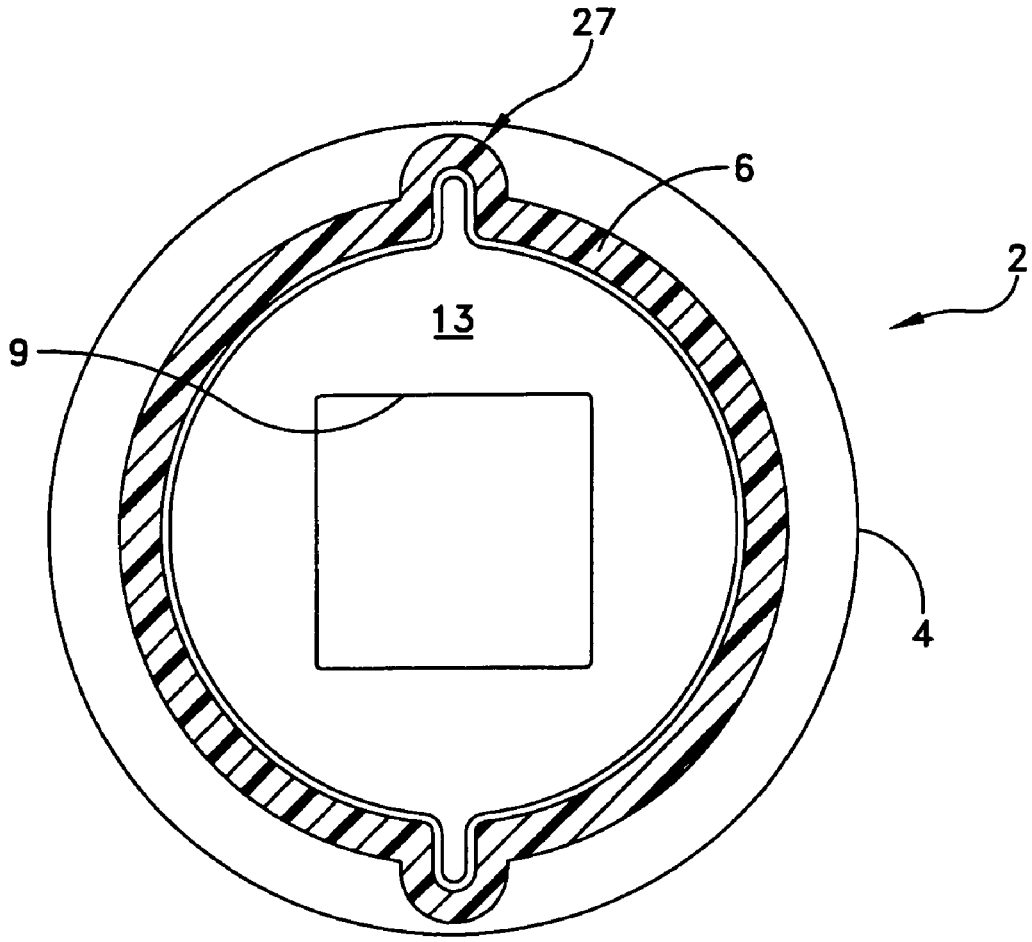
FIG. 7 is a rear cross-sectional view, as taken along lines 7-7 in FIG. 5.

Front plate 4 is often circular in shape and has a through-hole 9 defined substantially at its center. Through-hole 9 often comprises a rectangular or square-shaped profile. Front plate 4 may include one or more grooves 11 that are defined in its surface in a cruciform arrangement so as to be at substantially ninety-degrees to one another around the face of front plate 4. Tubular insert 6 projects outwardly from a back surface 13 of front plate 4 so as to define an annular inner surface 16 that is arranged in surrounding relation to through-hole 9. The outer surface of tubular insert 6 includes a plurality of circumferentially arranged, spaced-apart, parallel ridges 20. Circumferential ridges 20 often have a triangular cross-sectional profile including an inclined outer surface 22 and a flat shoulder surface 23 so as to form a plurality of parallel serrations on the outer surface of tubular insert 6 (FIGS. 5 and 6). Circumferential ridges each have an edge 25 that is defined by the intersection of inclined outer surface 22 and flat shoulder surface 23.

A pair of pilot fins 27 are arranged one hundred and eighty degrees apart on the outer surface of tubular insert 6 so as to be in confronting, coaxial relation to one another. The outer surface of each pilot fin 27 includes a plurality of circumferentially arranged, spaced-apart, parallel ridges 28 that are coextensive with ridges 20. Parallel ridges 28 often also have a triangular cross-sectional profile including an inclined outer surface 32 and a flat shoulder surface 33 so as to form a plurality of parallel serrations. Parallel ridges 28 each have an edge 35 that is defined by the intersection of inclined outer surface 32 and flat shoulder surface 33.

Figure 8:
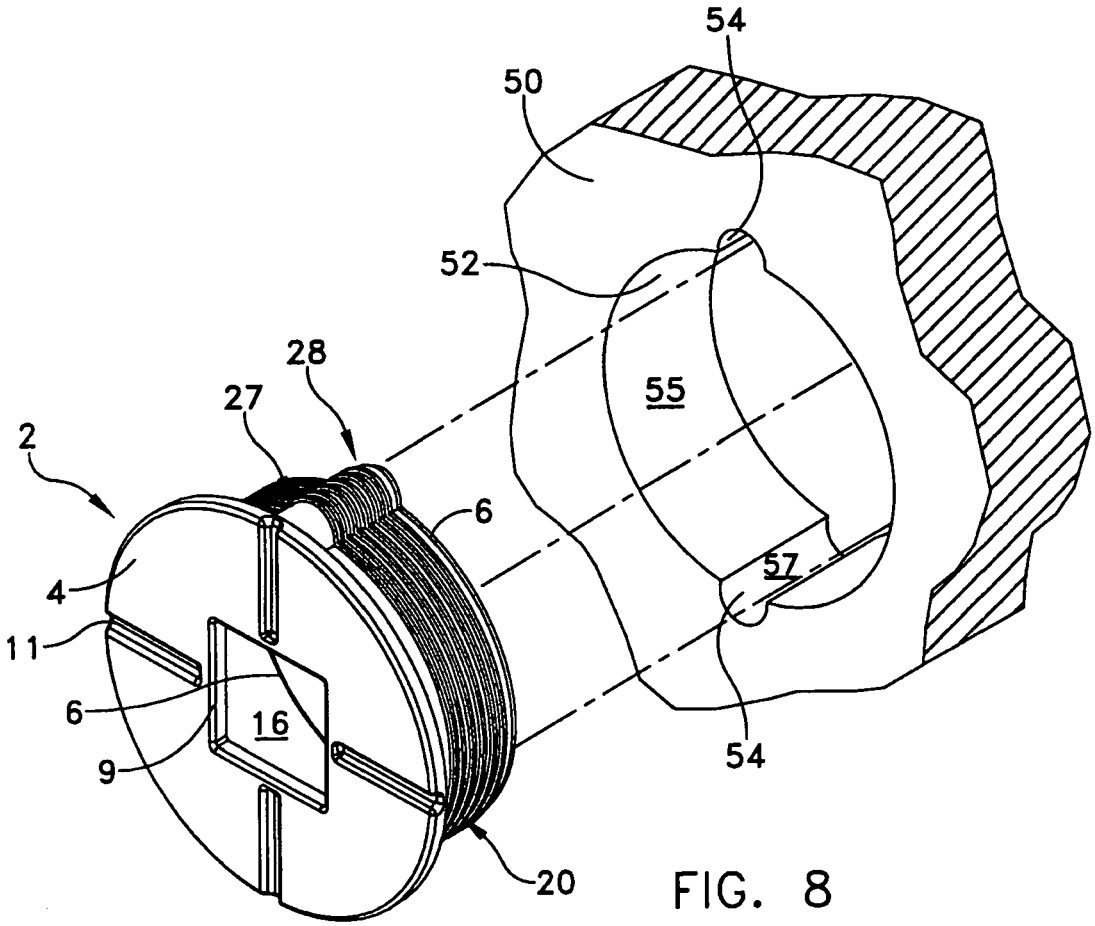
FIG. 8 is a perspective exploded view, partially broken-away, of a pegboard wall-plug positioned adjacent to a wall of a structure ready for mounting.
Figure 9:
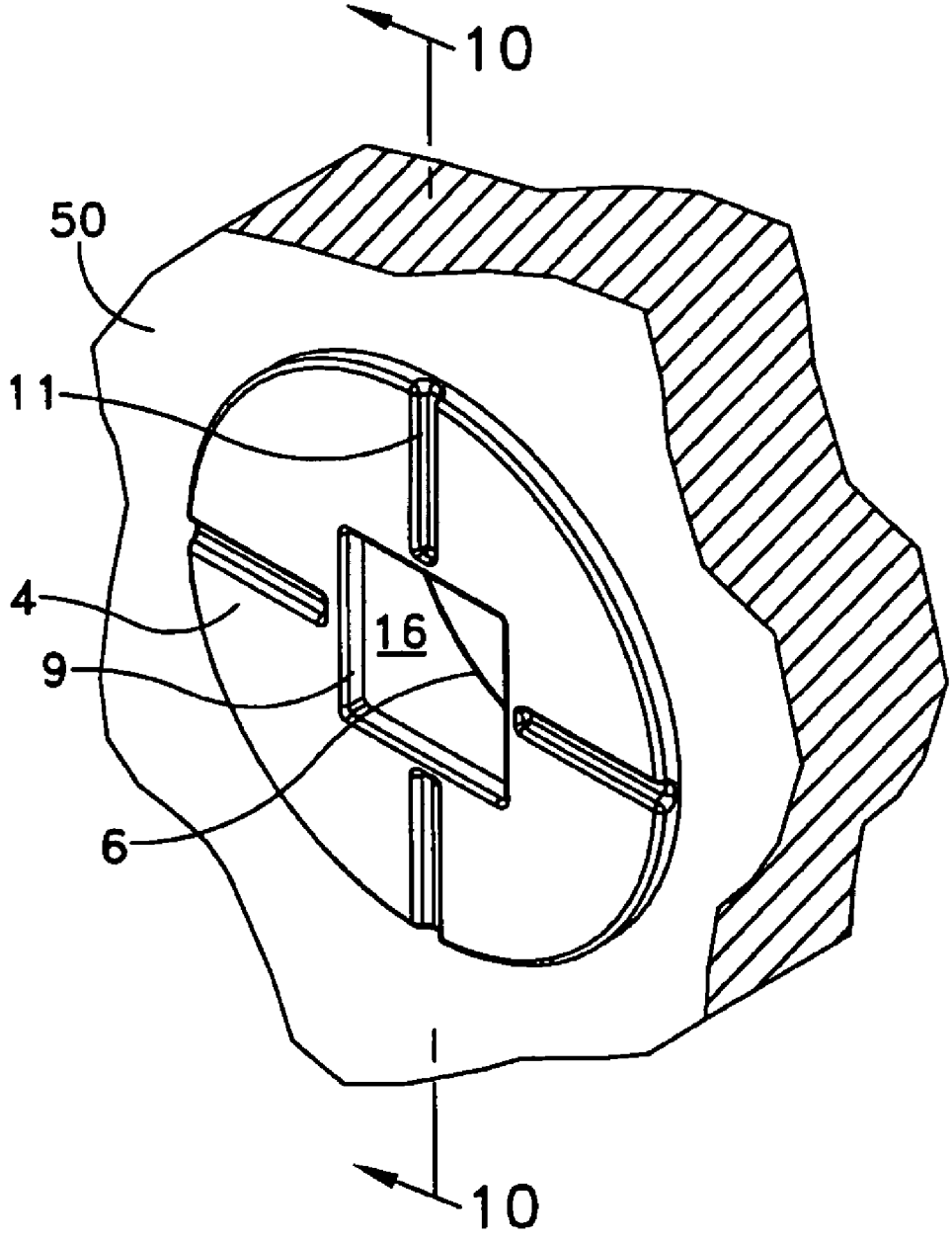
FIG. 9 is a perspective broken-away view of the pegboard wall-plug mounted in the wall shown in FIG. 8.
Figure 10:
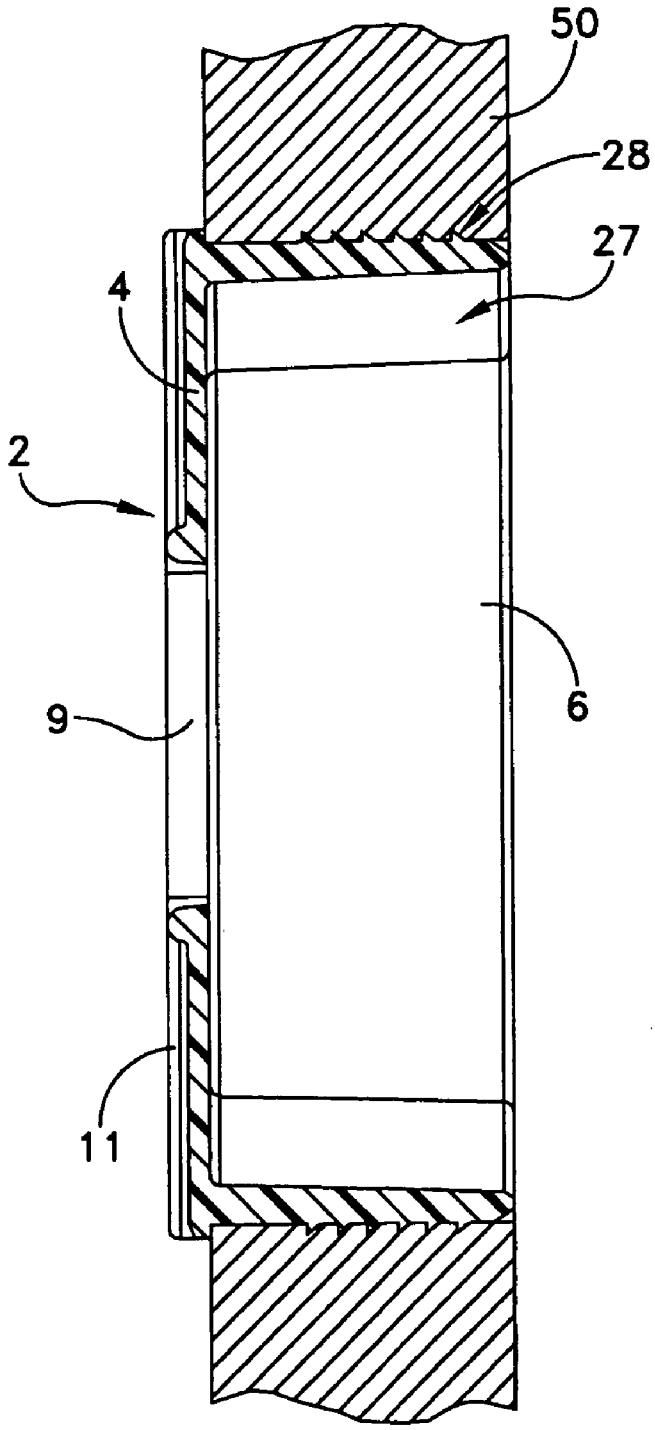
FIG. 10 is a cross-sectional view of the pegboard wall-plug mounted in a wall as taken along lines 10-10 in FIG. 9.
Figure 14:
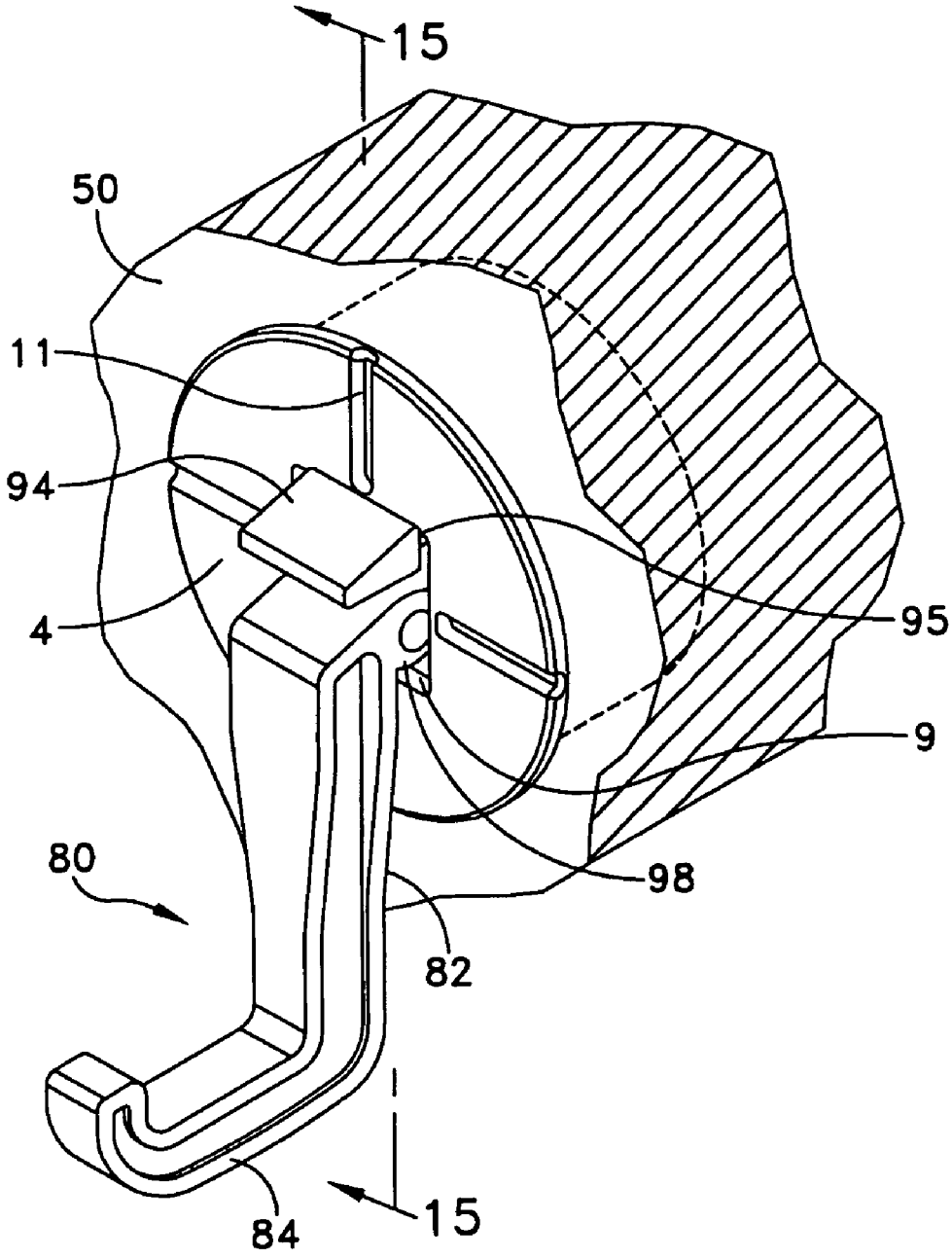
FIG. 14 is a perspective broken-away view of a pegboard wall-plug and wall, with the item holder snapped in place within the pegboard wall-plug.
Figure 15:
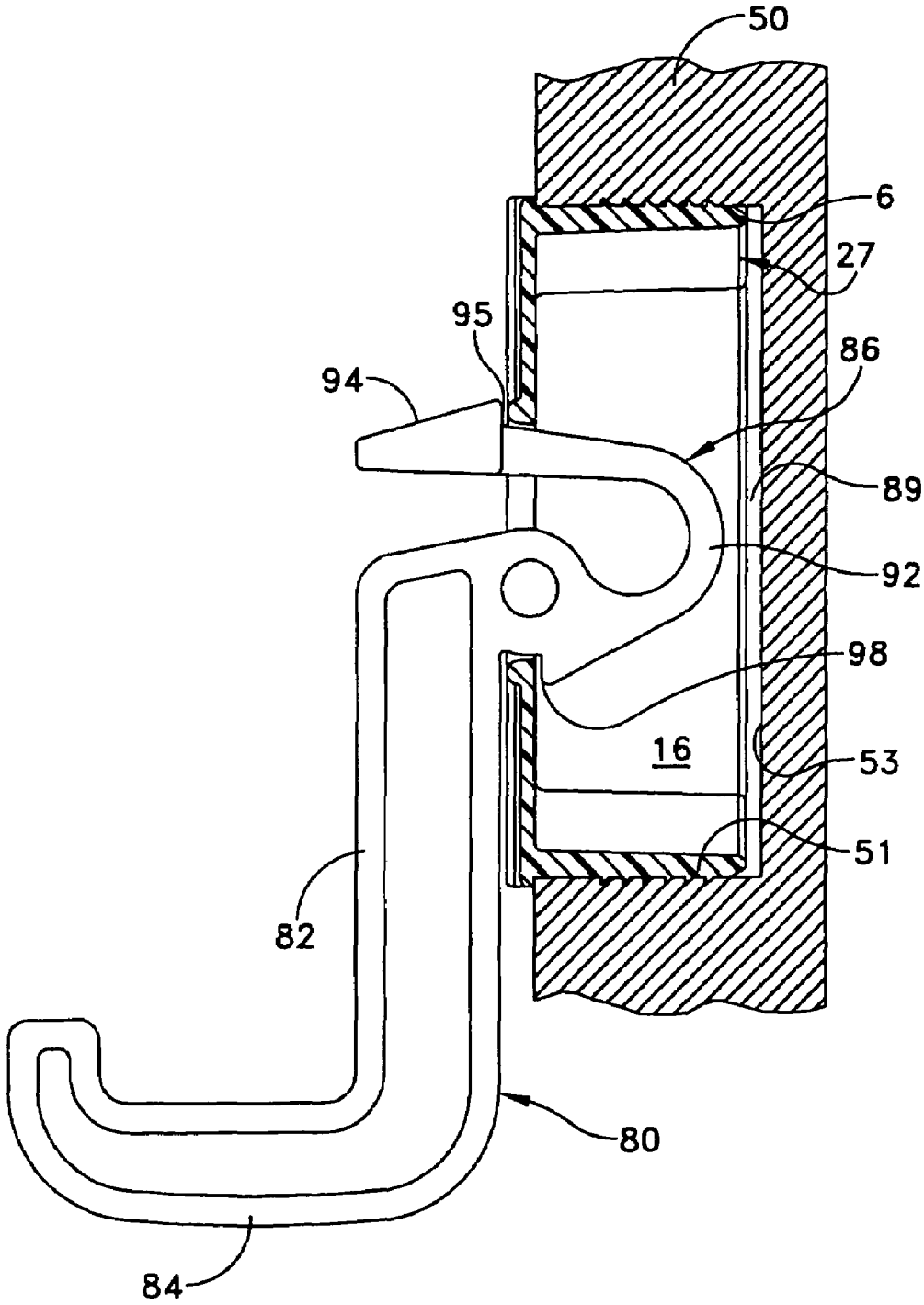
FIG. 15 is a cross-sectional view of the pegboard wall-plug and item holder shown in FIG. 14, as taken along lines 15-15 in FIG. 14.

Referring to FIGS. 8-10, pegboard wall-plug 2 is adapted for mounting on a wall 50 on the exterior or interior of a building or other structure. A hole 52 is formed in wall 50 that is approximately the diameter of a tubular insert 6 without parallel ridges 20 so that hole 52 has an internal diameter that is less than the outer diameter of each parallel ridge 20, but greater than the internal diameter of tubular insert 6. Hole 52 may entirely pierce wall 50, i.e., be defined through the thickness of a standard wall board, or be a "blind" hole 51, i.e., an opening defined partially through the thickness of the material forming wall 50 (FIG. 14). When a blind hole 51 is defined in wall 50, a transverse portion 53 of the interior of wall 50 extends across the rear of blind hole 51 closing it off and blocking further penetration. A pair of pilot slots 54 defined in the inner surface 55 of wall 50 that defines hole 52, and are arranged one hundred and eighty degrees apart so as to be in confronting, aligned relation to one another. Inner surface 57 of wall 50 that defines each pilot slot 54 extends inwardly, toward a back or rear surface (not shown) of wall 50.

Pegboard wall-plug 2 is positioned within wall 50 by first orienting pegboard wall-plug 2 so that tubular insert 6 is arranged in spaced, confronting coaxial relation to hole 52. Care must be taken to ensure that each pilot fin 27 is arranged so as to be in aligned relation with a respective one of pilot slots 54. In this way, the proper orientation of pegboard wall-plug 2 may be maintained on wall 50. Once in this position, pegboard wall-plug 2 is moved toward wall 50 such that tubular insert 6 enters hole 52 (hole 51) with pilot fins 27 simultaneously entering each of their respective pilot slots 54. As this occurs, parallel ridges 20 engage surface 55 of wall 50 that defines hole 52 such that each edge 25 bites into wall 50, i.e., cuts into and through surface 55 to hold pegboard wall-plug 2 tightly in place. At the same time, parallel ridges 28 of each pilot fin 27 engage surface 57 of wall 50 that defines each pilot slot 54 such that each edge 35 bites into wall 50, i.e., cuts into and through surface 57 to hold pegboard wall-plug 2 tightly in place. In this way, pegboard wall-plug 2 is fixedly positioned in wall 50.

Figure 11:
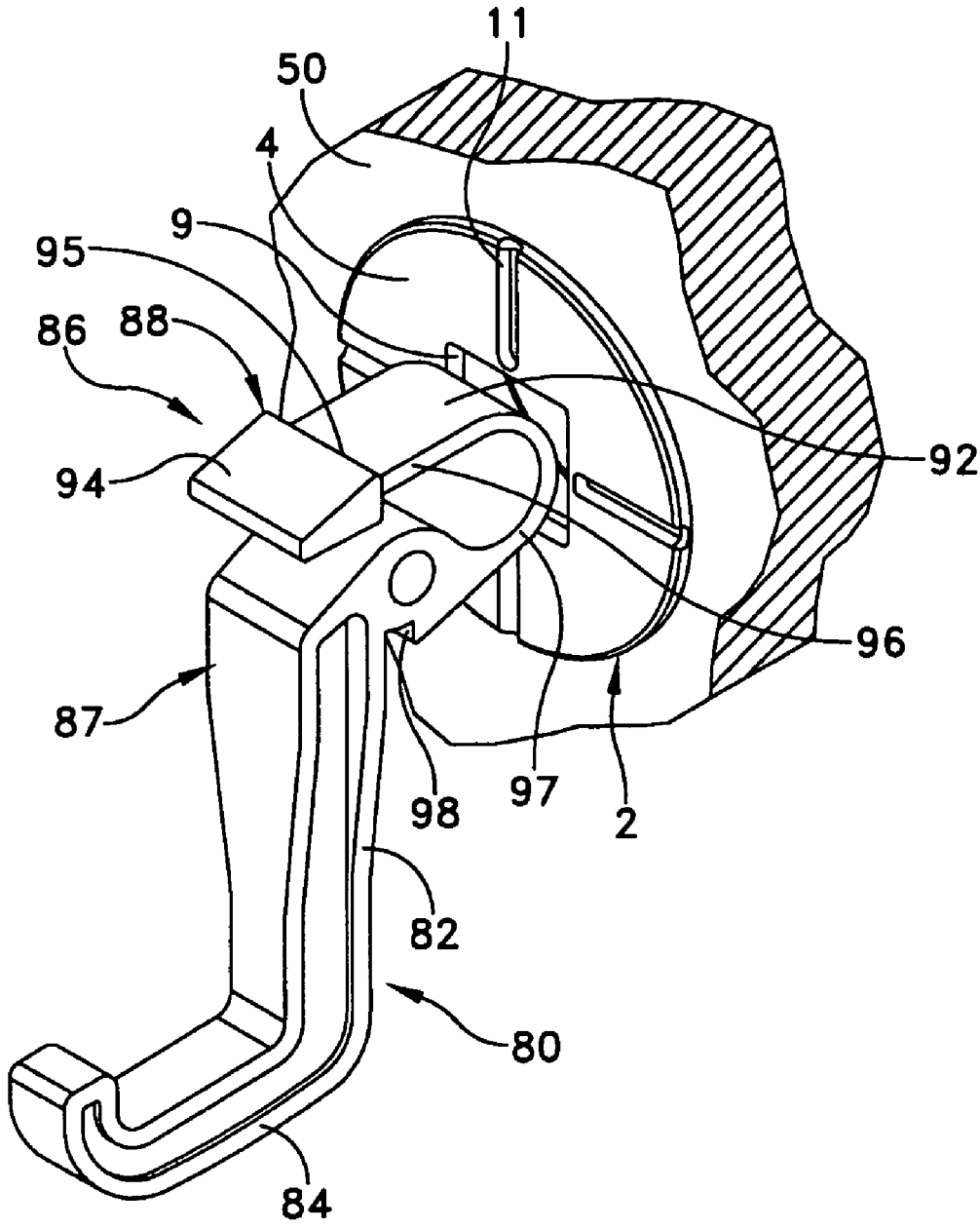
FIG. 11 is a perspective broken-away and exploded view of a pegboard wall-plug mounted within a wall and having an item holder positioned for engagement with the pegboard wall-plug.
Figure 12:
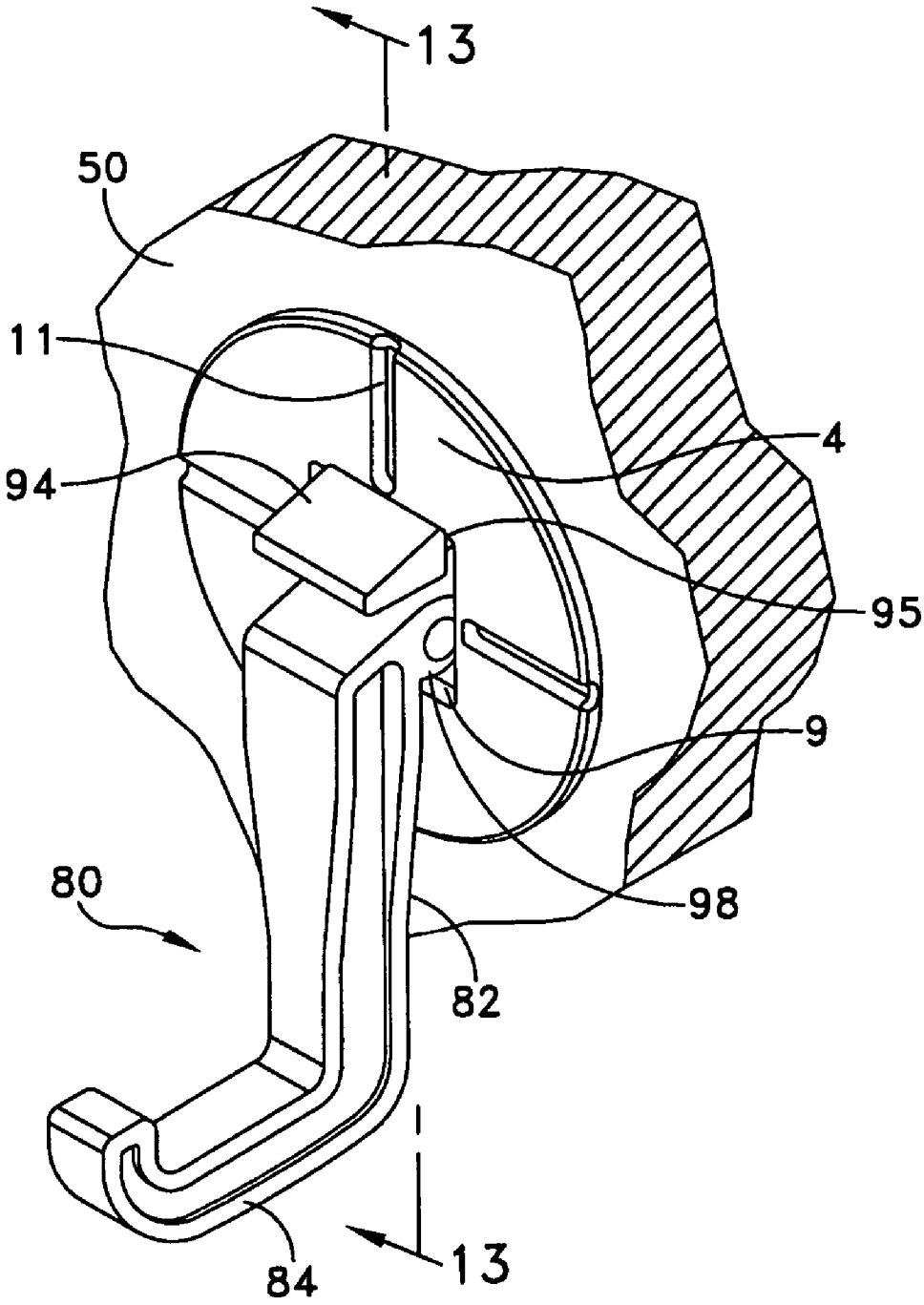
FIG. 12 is a perspective broken-away view of the pegboard wall-plug and wall shown in FIG. 11, with the item holder snapped in place within the pegboard wall-plug.
Figure 13:
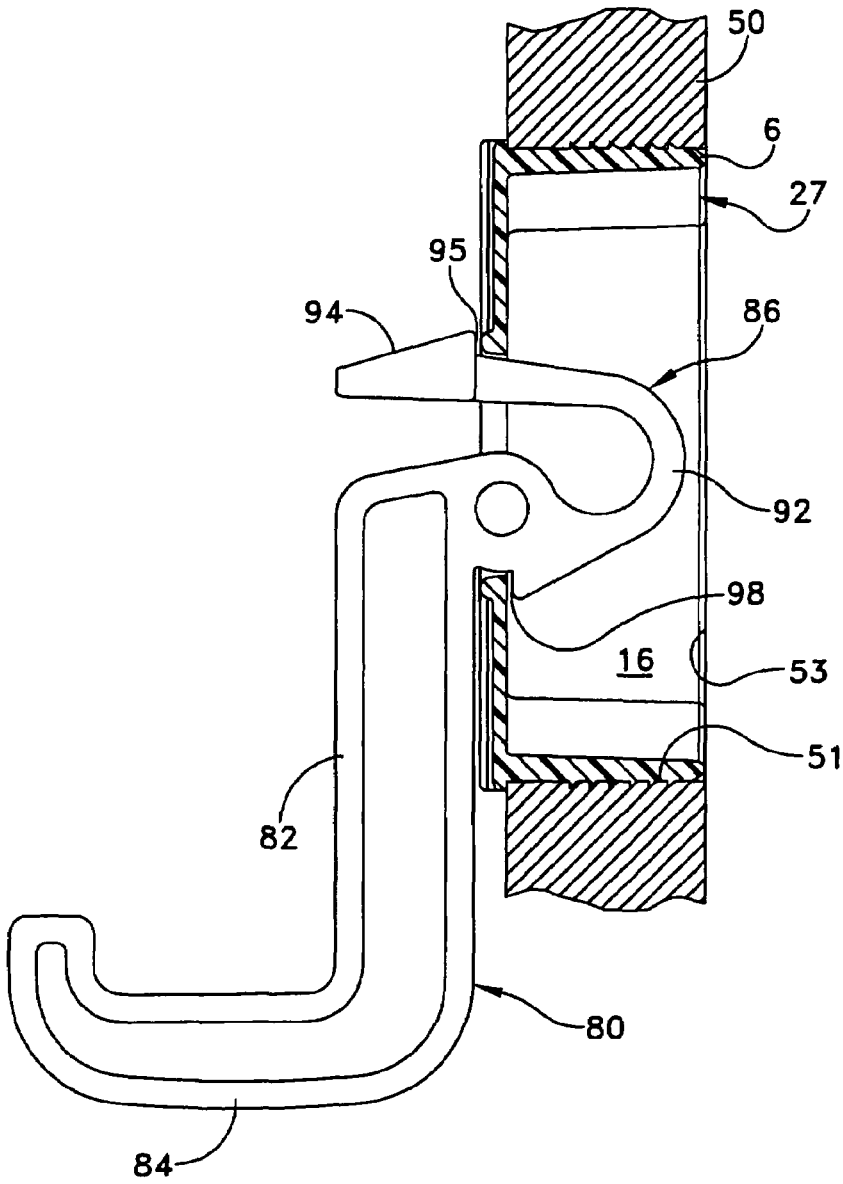
FIG. 13 is a cross-sectional view of the pegboard wall-plug and item holder shown in FIG. 12, as taken along lines 13-13 in FIG. 12.

Referring to FIGS. 11-13, an item holder, such as a hook or a shelf bracket, may be mounted to pegboard wall-plug 2 so as to support a wide variety of things. For example, a hook 80 may be directly supported by pegboard wall-plug 2 so as to advantageously store additional items. More particularly, hook 80 comprises a shank 82, a support arm 84, and a catch 86. Shank 82 and support arm 84 form a conventional hook of the type known for hanging tools and other items. Hook 80 may be formed from any of the well known polymer or metal materials that are known to exhibit good spring characteristics.

Catch 86 comprises a stop tab 88 and a cantilevered strap 92 that are located adjacent to a top portion 87 of shank 82. Stop 88 includes a nose, a pair of inclined surfaces forming a ramp 94, and a shoulder surface 95 so as to form a wedge-shaped tab. A first end 96 of cantilevered strap 92 projects outwardly from shoulder surface 95 and a second end 97 of cantilevered strap 92 projects outwardly from top portion 87 of shank 82, so that cantilevered strap 92 comprises a curved profile. Cantilevered strap 92 may have a variety of cross-sectional shapes, e.g., rectangular, circular, elliptical, etc., so long as a fully elastic spring is created by the structure of the strap. A transverse slot 98 is defined through the underside of cantilevered strap 92 between top portion 87 of shank 82 and second end 97 of cantilevered strap 92. Slot 98 is sized and shaped to accept an edge portion of front plate 4 that defines through-hole 9 of pegboard wall-plug 2.

Hook 80 may be assembled to any pegboard wall-plug 2, as shown in FIGS. 11-12. More particularly, hook 80 is arranged adjacent to pegboard wall-plug 2 such that support arm 84 is directed away from front plate 4, and cantilevered strap 92 is arranged in coaxially aligned, confronting relation to hole 52 in wall 50 (FIG. 11). Ramp 94 of stop 88 is then depressed, deflecting cantilevered strap 92 such that the underside of stop 88 moves toward top portion 87 of shank 82. Once in this position, hook 80 is moved toward hole 52 (or hole 51) until shoulder surface 95 engages the front surface of front plate 4 that surrounds hole 52, and the edge of front plate 4 that defines through-hole 9 engages slot 98 of catch 86. Pressure is then released from ramp 94 so as to allow cantilevered strap 92 to spring back towards its original, undeflected position, and thereby engage the internal edges of front plate 4 that define through-hole 9. When hook 80 is assembled to pegboard wall-plug 2 located within a blind hole 51, cantilevered strap 92 does not extend beyond the edge of tubular insert 6 so as to not engage transverse portion 53 of wall 50 thereby defining a void space 89 between it and transverse portion 53. In order to remove catch 86 from pegboard wall-plug 2, it is only necessary to grip shank 82 and move it toward stop 88, once again deflecting cantilevered strap 92, and thereby disengaging the edge of perforated front plate 4 that defines through-hole 9 from slot 98 of catch 86. Once cantilevered strap 92 is deflected, hook 80 may be withdrawn from pegboard wall-plug 2.

It is to be understood that the present invention is by no means limited only to the particular constructions herein disclosed and shown in the drawings, but also comprises any modifications or equivalents within the scope of the claims.

What is claimed is:

1. A system for storing an item comprising:

a pegboard wall-plug having a plate including a central opening, and a tube projecting outwardly from a rear surface of said plate in surrounding relation to said central opening, and including a plurality of circumferentially arranged, spaced-apart parallel ridges projecting outwardly from a surface of said cylindrical tube;

a hole defined by a surface of a wall said surface defining a diameter of said hole that is less than a diameter of at least one of said circumferentially arranged, spaced-apart parallel ridges so that when said tube is received within said hole, said circumferentially arranged, spaced-apart parallel ridges engage and bite into said surface so as to retain said pegboard wall-plug in said wall; and an item holder including a catch located at an end wherein said catch comprises a curved cantilevered strap projecting from said end and having a stop tab located at a strap end positioned above, but spaced away from said end wherein when said cantilevered strap is inserted into said central opening defined through said plate, said catch is releasably engaged with said plate with said stop tab being positioned on a front surface of said plate.

2. A system according to claim 1 wherein said plurality of circumferential ridges have a triangular cross-sectional profile including an inclined outer surface and a flat shoulder surface so as to form a plurality of parallel serrations on an outer surface of said tube.

3. A system according to claim 1 wherein said plurality of circumferential ridges each have an edge that is defined by the intersection of an inclined outer surface and a flat shoulder surface.

4. A system according to claim 1 wherein said tube includes a pair of pilot fins arranged one hundred and eighty degrees apart on an outer surface so as to be in confronting, coaxial relation to one another.

5. A system according to claim 2 wherein each of said pilot fins includes a plurality of circumferentially arranged, spaced-apart, parallel ridges.

6. A system according to claim 1 wherein said plurality of circumferential ridges have a triangular cross-sectional profile including an inclined outer surface and a flat shoulder surface so as to form a plurality of parallel serrations on an outer surface of said tube, and further wherein said tube includes a pair of pilot fins arranged one hundred and eighty degrees apart on an outer surface so as to be in confronting, coaxial relation to one another with each of said pilot fins including a plurality of circumferentially arranged, spaced-apart, parallel ridges that are coextensive with said ridges on each of said pilot fins.

7. A system according to claim 4 wherein said surface in said wall also defines a pair of pilot slots arranged one hundred and eighty degrees apart so as to be in confronting, aligned relation to one another so that each of said pair of pilot slots is arranged in complementary alignment with a respective one of said pair of pilot fins.

8. A system for supporting an item being stored comprising:

a pegboard wall-plug having a plate including a central opening, and a tube projecting outwardly from a rear surface of said plate in surrounding relation to said central opening, and including a circumferential end edge and a plurality of circumferentially arranged, spaced-apart parallel ridges projecting outwardly from a surface of said cylindrical tube;

a blind hole defined by an inner circumferential surface and an inner transverse surface of a wall, said inner circumferential surface defining a diameter of said hole that is less than a diameter of at least one of said circumferentially arranged, spaced-apart parallel ridges so that when said tube is received within said hole, said circumferentially arranged, spaced-apart parallel ridges engage and bite into said surface so as to retain said pegboard wall-plug in said wall with said circumferential end edge rests upon said inner transverse surface of said wall; and an item holder including a catch located at an end wherein said catch comprises a curved cantilevered strap projecting from said end and having a stop tab located at a strap end positioned above, but spaced away from said end wherein when said cantilevered strap is inserted into said central opening defined through said plate, said catch is releasably engaged with said plate with said stop tab being positioned on a front surface of said plate and void defined between said cantilevered strap and said inner transverse surface of said wall.

9. A system according to claim 8 wherein said plurality of circumferential ridges have a triangular cross-sectional profile including an inclined outer surface and a flat shoulder surface so as to form a plurality of parallel serrations on an outer surface of said tube.

10. A system according to claim 9 wherein said plurality of circumferential ridges each have an edge that is defined by the intersection of said inclined outer surface and said flat shoulder surface.

11. A system according to claim 10 wherein said tube includes a pair of pilot fins arranged one hundred and eighty degrees apart on an outer surface so as to be in confronting, coaxial relation to one another.

12. A system according to claim 11 wherein each of said pilot fins includes a plurality of circumferentially arranged, spaced-apart, parallel ridges.

13. A system according to claim 12 wherein said plurality of circumferential ridges have a triangular cross-sectional profile including an inclined outer surface and a flat shoulder surface so as to form a plurality of parallel serrations on an outer surface of said tube, and further wherein said tube includes a pair of pilot fins arranged one hundred and eighty degrees apart on an outer surface so as to be in confronting, coaxial relation to one another with each of said pilot fins including a plurality of circumferentially arranged, spaced-apart, parallel ridges that are coextensive with said ridges on each of said pilot fins.

14. A system according to claim 13 wherein said surface in said wall also defines a pair of pilot slots arranged one hundred and eighty degrees apart so as to be in confronting, aligned relation to one another so that each of said pair of pilot slots is arranged in complementary alignment with a respective one of said pair of pilot fins.

* * * * *